US006658134B1

(12) United States Patent
van Hal et al.

(10) Patent No.: US 6,658,134 B1
(45) Date of Patent: Dec. 2, 2003

(54) SHOCK IMPROVEMENT FOR AN ELECTROACOUSTIC TRANSDUCER

(75) Inventors: Paul Christiaan van Hal, Hoorn (NL); Benno Hartog, Grootebroek (NL)

(73) Assignee: SonionMicrotronic Nederland B.V., Amsterdam (NL)

( * ) Notice: Subject to any disclaimer, the term of this patent is extended or adjusted under 35 U.S.C. 154(b) by 0 days.

(21) Appl. No.: 09/375,182

(22) Filed: Aug. 16, 1999

(51) Int. Cl.[7] ..... H04R 25/00
(52) U.S. Cl. ..... 381/418; 381/417
(58) Field of Search ..... 381/322, 324, 381/417, 418, 354, FOR 160; 29/594

(56) References Cited

U.S. PATENT DOCUMENTS

| | | | |
|---|---|---|---|
| 1,871,739 A | 8/1932 | Ringel | |
| 2,143,097 A | 1/1939 | Warnke | 179/119 |
| 2,163,161 A | 6/1939 | Wadsworth | 175/339 |
| 2,794,862 A | 6/1957 | Topholm | 179/114 |
| 2,912,523 A | 11/1959 | Knowles et al. | 179/108 |

FOREIGN PATENT DOCUMENTS

| | | |
|---|---|---|
| DE | 1 146 542 | 2/1961 |
| EP | 0 094 992 B1 | 9/1986 |
| EP | 0 847 226 A1 | 6/1998 |
| FR | 564.941 | 4/1923 |
| FR | 551.182 | 5/1923 |
| GB | 2 085 694 | 4/1982 |
| WO | WO 99/03305 | 1/1999 |

OTHER PUBLICATIONS

Gawinski, Michael J., *Hearing Aid Transducer Damage: A Practical Guide to Prevention*, The Hearing Journal, Oct. 1991. vol. 44, No. 10, pp. 1–4, Copyright 1991, The Laux Co., Inc.

(List continued on next page.)

*Primary Examiner*—Huyen Le
(74) *Attorney, Agent, or Firm*—Jenkens & Gilchrist

(57) ABSTRACT

A transducer comprising a coil having a first air gap, a magnetic member having a second air gap and an armature. The armature includes an armature leg that extends through the first and second air gaps. The armature leg is capable of movement-within the air gaps. The magnetic member includes at least one nub extending into the second air gap. The nub limits the movement of the armature leg within the second air gap.

32 Claims, 3 Drawing Sheets

U.S. PATENT DOCUMENTS

| | | | | |
|---|---|---|---|---|
| 2,994,016 | A | 7/1961 | Tibbetts et al. | 317/172 |
| 3,005,880 | A | 10/1961 | Simshauser | 179/114 |
| 3,111,563 | A | 11/1963 | Carlson | 179/114 |
| 3,163,723 | A | 12/1964 | Tibbetts | 179/180 |
| 3,172,022 | A | 3/1965 | Tibbetts | 317/173 |
| 3,177,412 | A | 4/1965 | Carlson | 317/173 |
| 3,182,384 | A | 5/1965 | Carlson et al. | 29/155.57 |
| 3,249,702 | A | 5/1966 | Carlson | 179/115 |
| 3,347,991 | A | 10/1967 | Carlson | 179/114 |
| 3,413,424 | A | 11/1968 | Carlson | 179/115 |
| 3,432,622 | A | 3/1969 | Sebesta et al. | 179/115 |
| 3,531,745 | A | 9/1970 | Tibbetts | 335/231 |
| 3,560,667 | A | 2/1971 | Carlson | 179/114 |
| 3,573,397 | A | 4/1971 | Sawyer et al. | 179/115 |
| 3,588,383 | A | 6/1971 | Carlson et al. | 179/119 A |
| 3,617,653 | A | 11/1971 | Tibbetts et al. | 179/114 A |
| 3,671,684 | A | 6/1972 | Tibbetts et al. | 179/117 |
| 3,766,332 | A | 10/1973 | Carlson et al. | 179/114 |
| 3,836,733 | A | 9/1974 | Cragg | 179/119 |
| 3,885,553 | A | 5/1975 | Vecchio | 128/24.1 |
| 3,935,398 | A | 1/1976 | Carlson et al. | 179/114 |
| 3,979,566 | A | 9/1976 | Willy | 179/115.5 |
| 4,000,381 | A | 12/1976 | Plice et al. | 179/114 |
| 4,015,227 | A | 3/1977 | Riko et al. | 335/231 |
| 4,272,654 | A | 6/1981 | Carlson | 179/119 |
| 4,360,711 | A | 11/1982 | Steiner | 179/115 |
| 4,410,769 | A | 10/1983 | Tibbetts | 179/119 |
| 4,425,482 | A | 1/1984 | Bordelon et al. | 179/120 |
| 4,518,831 | A | 5/1985 | Stanley et al. | 179/119 |
| 4,944,017 | A | 7/1990 | Cognasse et al. | 381/79 |
| 4,956,868 | A | 9/1990 | Carlson | 381/189 |
| 5,068,901 | A | 11/1991 | Carlson | 381/68.6 |
| 5,193,116 | A | 3/1993 | Mostardo | 381/69 |
| 5,299,176 | A | 3/1994 | Tibbetts | 367/175 |
| 5,335,286 | A | 8/1994 | Carlson et al. | 381/191 |
| 4,473,722 | A | 6/1995 | Wilton | 381/200 |
| 5,647,013 | A * | 7/1997 | Salvage et al. | 381/418 |
| 5,809,158 | A | 9/1998 | van Halteren et al. | 381/200 |

* cited by examiner

SHOCK IMPROVEMENT FOR AN ELECTROACOUSTIC TRANSDUCER

FIELD OF THE INVENTION

The present invention relates generally to a transducer and, more particularly, to a shock resistant transducer particularly suitable for hearing aids.

BACKGROUND OF THE INVENTION

Transducers are particularly useful in hearing aids. The transducer may be used as a microphone to convert acoustic energy into electrical energy or as a receiver to convert electrical energy into acoustic energy. Typical transducers suitable for hearing aids comprise a coil having a first air gap, a magnetic member having a second air gap and an armature with an armature leg that extends through both of the air gaps. A diaphragm connects to the armature leg.

The operation of the transducer follows. Vibrations of the diaphragm are transmitted to the armature leg, and the vibrating armature leg causes an electric alternating electric current in the coil. Conversely, an alternating current supplied to the coil causes a vibration of the armature leg, which is transmitted to the diaphragm. Under normal conditions the vibrations of the armature leg are relatively small displacements. In extreme cases, however, the armature leg may deflect a large amount and touch the magnetic member.

One problem with the conventional transducers is that a shock or impact load exerted on the transducer may cause plastic deformation of the armature leg. For example, when the transducer falls and contacts a solid object, the armature leg deflects or bends so far that undesirable plastic deformation can occur in the armature leg. Once the armature leg is plastically deformed such that it is closer to one side of the magnetic member than the other in a steady-state condition, the transducer does not function properly.

Some conventional transducers have attempted to address this shock problem. For example, Knowles Electronics, Inc. produces a transducer (e.g. Model ED1913) with deformations on a central portion of the armature leg that is positioned within the air gap of the coil. When the Knowles transducer suffers a shock, the armature leg deflects until the deformations contact the surface of the coil, thus limiting the freedom of movement of the armature leg. One example of the Knowles transducer is generally disclosed in U.S. Pat. No. 5,647,013. Another example of a conventional transducer with shock resistance is produced by the assignee of the present applicant Microtronic BNV. The Microtronic transducer (2300 series) has a rotated coil with respect to the magnetic member. This rotation forms a stop for the armature leg to inhibit excessive bending of the armature leg in the occurrence of a shock. One example of the Microtronic transducer is generally disclosed in European Patent Application No. 847,226.

One disadvantage of the above transducers is that the shock resistance, though improved, does not meet the increasing shock standards of the hearing aid industry. Furthermore, especially for the Knowles transducer, special and/or additional parts must be used to provide the shock resistance which increase the expense of the transducer.

It is a general object of the present invention to solve the above problems. More particularly, there is desired a transducer with superior shock resistance, and which can be easily assembled from standard parts at a low cost.

SUMMARY OF THE INVENTION

According one aspect of the present invention, there is provided a transducer comprising a coil having a first air gap, a magnetic member having a second air gap and an armature. The armature includes an armature leg extending through the first air gap and the second air gap. The armature leg is capable of movement within the air gaps. The magnet member has at least one nub extending into the second air gap that limits the range of motion of the armature leg to inhibit large deflections of the armature leg and plastic deformation. The nubs may be comprised of a drop of adhesive.

In another aspect of the present invention, there is provided a transducer suitable for hearing aids comprising a coil having a first air gap, a magnetic assembly having a second air gap and an armature. The armature includes an armature leg that extends through both the first air gap and the second air gap. The armature leg is capable of movement within the second air gap. The magnetic assembly has a cushioning element secured to the magnetic assembly that extends into the second air gap. When the transducer is subjected to a shock, the movement of the armature leg is limited as it engages the cushioning element. Furthermore, the cushioning element may comprise a soft material to absorb a portion of an impact of the armature leg when the armature leg moves into contact with the cushioning element.

BRIEF DESCRIPTION OF THE DRAWINGS

The forgoing and other advantages of the invention will become apparent upon reading the following detailed description and upon reference to the drawings in which.

Figure 1:
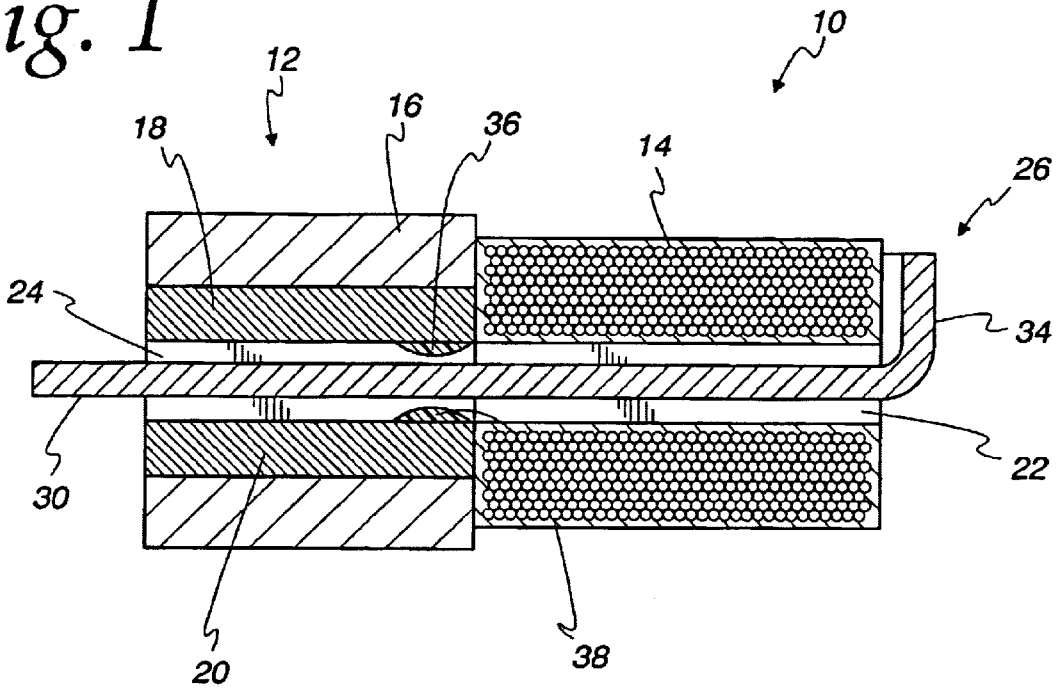
FIG. 1 is a cross-sectional side view of a shock resistant transducer according to one embodiment of the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF SPECIFIC EMBODIMENTS

Figure 2:
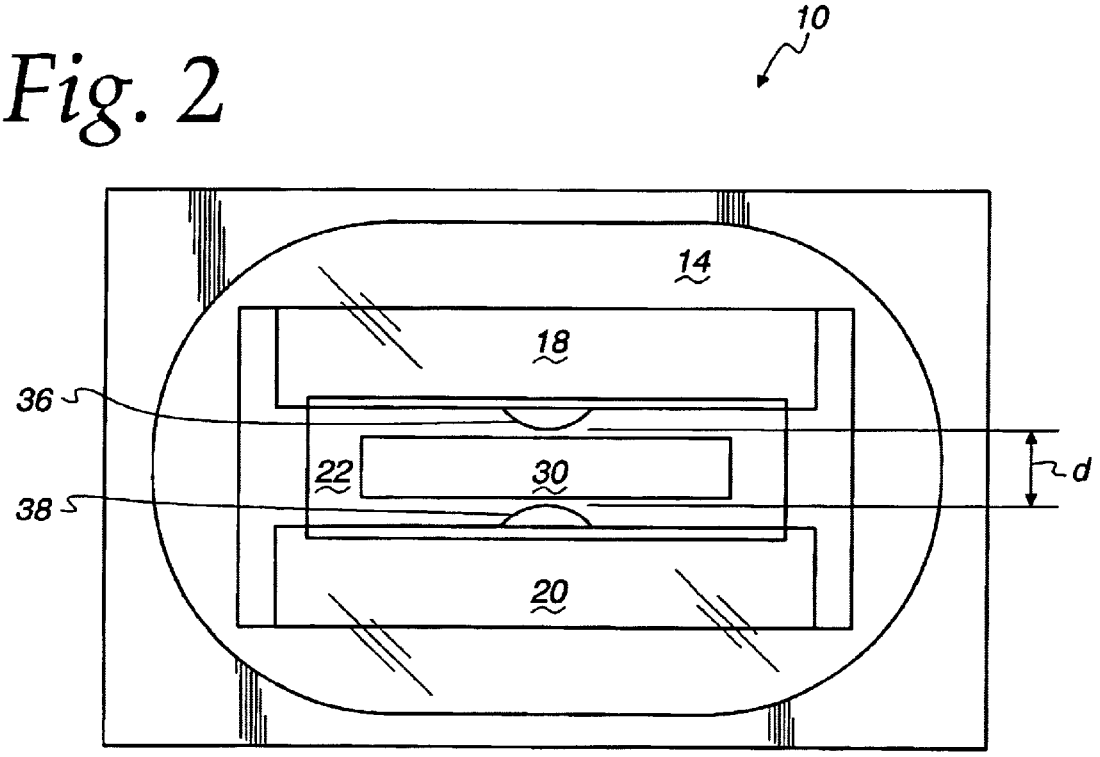
FIG. 2 is a cross-sectional front view of the transducer of FIG. 1.

Turning now to the drawings and referring initially to FIG. 1, there is depicted a longitudinal sectional view of a shock resistant transducer 10 according to the present invention. The transducer 10 comprises a magnetic member 12 and a coil 14. In the illustrated embodiment, the magnetic member 12 comprises a magnet housing 16 and two spaced apart magnetic elements 18 and 20. The coil 14 has a first air gap 22. As depicted in FIG. 2, the cross section of the first air gap 22 is substantially rectangular; however, the first air gap may have a different cross sectional shape in other embodiments. The magnetic elements 18 and 20 define a second air gap 24. The cross section of the second air gap 24 is substantially rectangular; however, the second air gap may have a different cross sectional shape in other embodiments. As shown in FIG. 1, the two air gaps 22 and 24 are substantially aligned with each other. When viewed in the cross section of FIG. 2, the edges of the rectangular first air gap are parallel to the respective edges of the rectangular second air gap 24. In other embodiments, one of the air gaps may be rotated relative to the other air gap. When the rotated embodiment is viewed in the cross section, the edges of the rectangular first air gap are not parallel to the respective edges of the rectangular second air gap.

Figure 3:
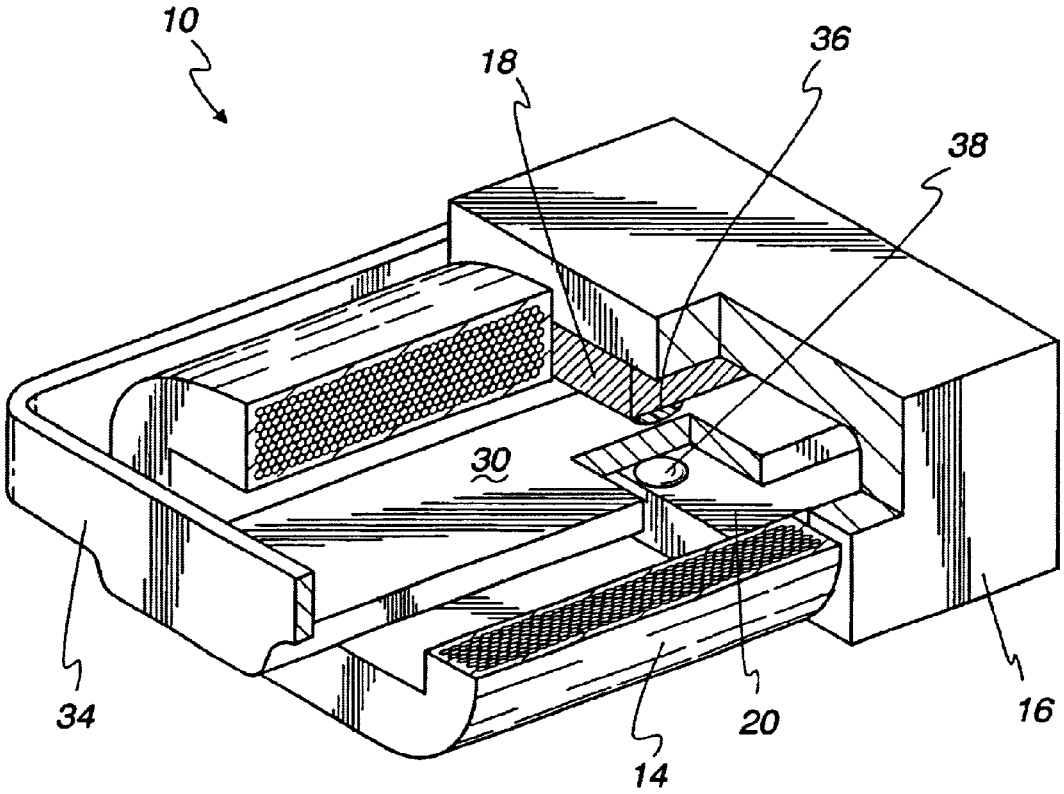
FIG. 3 is a perspective view of the transducer in FIG. 1.
Figure 4:
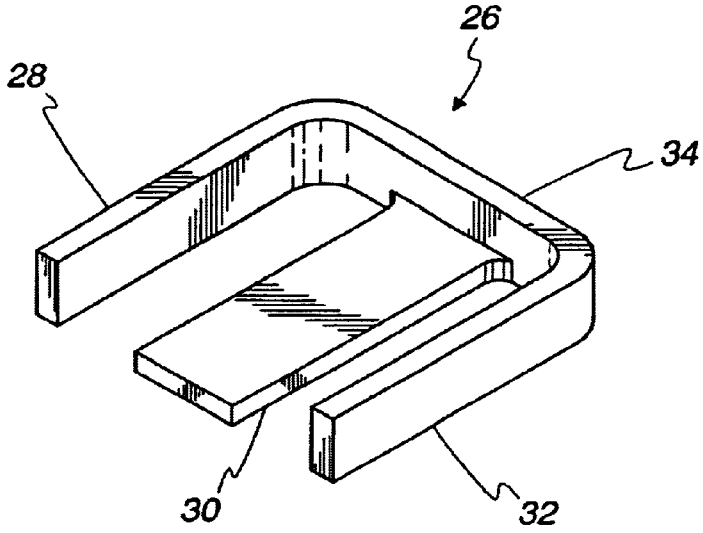
FIG. 4 is a perspective view of the armature of the transducer in FIG. 1.

The transducer 10 further comprises an armature 26. The armature 26, as more completely illustrated in FIG. 4, is an E-shaped armature. In other embodiments, the armature may have a U-shape. In general, the E-shaped armature 26 has three legs 28, 30 and 32, lying generally parallel with each other and interconnected at one end by a leg connecting part 34. As illustrated in FIG. 3, the middle armature leg 30 is positioned within the two aligned air gaps 22 and 24 with the leg connecting part 34 being located on the side of coil 14. The two outer armature legs 28 and 32 extend on the outer side along the coil 14 and the magnet housing 12. Although not shown, the two outer armature legs 28 and 32 are affixed to the magnet housing 12. The free end of the middle armature leg 30 is connected to a diaphragm with a connecting element (not shown).

The operation of the transducer 10 follows. When an electrical signal, originating from an amplifier (not shown) is supplied to the coil 14, the middle armature leg 30 vibrates in cooperation with a magnetic field of the magnetic member 12. The movement of vibration of the middle armature leg 30 is transmitted via the connecting element to the diaphragm, which causes sound vibrations. Conversely, sound vibrations vibrate the diaphragm causing the middle armature leg 30 to vibrate via the connecting element. This vibration generates an electrical signal in the coil 14. The electrical signal may then be detected and processed accordingly.

Under normal conditions the vibrations of the armature leg are relatively small displacements. However, sometimes the transducer 10 may be subjected to a shock such as the result of an impact after a fall. The shock causes a large acceleration that is exerted on the middle armature leg 30. The shock deflects the middle armature leg 30 further from its state of equilibrium and beyond the typical vibrations of normal operation. To prevent the middle armature leg 30 from striking the magnetic elements 18 and 20 and potentially becoming plastically deformed, the transducer 10 includes a pair of nubs 36 and 38 secured to the magnetic elements 18 and 20. As illustrated in FIG. 2, the nubs 36 and 38 protrude into the second air gap 24 to inhibit an unduly large deflection of the middle armature leg 30. The nubs 36 and 38 provide a nub air gap identified by "d" in FIG. 2 that is smaller than the second air gap 24.

The nubs 36 and 38 provide shock resistance for the transducer 10 by inhibiting large deflections of the middle armature leg 30. During a large shock, the middle armature leg 30 will deflect and potentially strike one of the nubs 36 or 38. Without the nubs 36 and 38 during a shock, the middle armature leg 30 may deflect a large amount and possibly strike the magnetic element that may cause plastic deformation. The nubs 36 and 38 are positioned to limit the movement of the middle armature leg 30 to inhibit plastic deformation.

As depicted in FIG. 1, the nubs 36 and 38 are located on the magnetic elements 18 and 20 away from the free end of the middle armature leg 30 to allow freedom of movement of the middle armature leg 30 during normal operation of the transducer 10. This positioning of the nubs 36 and 38 avoids the nubs 36 and 38 from rubbing the free end of the middle armature leg 30 during normal operation to ensure maximum output of the transducer 10. Preferably, the nubs 36 and 38 are positioned at the coil end of the magnetic elements 18 and 20 to allow the free end of the middle armature leg 30 greater freedom of movement. This orientation of the nubs 36 and 38 also supports the middle armature leg 30 in the middle of its length during the shock. However, the nubs 36 and 38 may be positioned anywhere along the magnetic elements 18 and 20 such that the middle armature leg 30 has free movement during normal operation, but does not experience large deflections during shock.

As depicted in FIGS. 1 and 2, the nubs 36 and 38 are substantially symmetrically positioned around a longitudinal plane through the middle armature leg 30. This longitudinal plane is perpendicular to the direction of the operational motion of the middle armature leg 30. In other embodiments, the nubs may be asymmetrical to the longitudinal plane and have different orientations as long as the middle armature leg has freedom of movement in normal operation and large deflections of the middle armature leg are inhibited. In FIGS. 1 and 2, the nubs 36 and 38 have a rounded exterior (i.e. a drop shape). In other embodiments, the nubs may have a different shape. Although only one pair of nubs is illustrated, additional pairs of these nubs may be applied to the magnetic elements 18 and 20 to provide shock resistance.

In one embodiment, the nubs 36 and 38 comprise drops of UV-cured adhesive adhered to the magnetic elements 18 and 20. In other embodiments, different materials secured to the magnetic elements may be used to meet the movement limiting function of the nubs 36 and 38. Furthermore, the nubs 36 and 38 may be unitary with the magnetic elements 18 and 20 such as deformations on the surface of the magnetic elements 18 and 20.

Not only do the nubs 36 and 38 limit large deflections of the middle armature leg 30, but the nubs 36 and 38 may be configured to also cushion the middle armature leg 30 during shocks. In the cushioning embodiment, the nubs 36 and 38 comprise a softer material such as an elastoner, an epoxy, or a plastic. When the nubs are comprised of softer material, the nubs 36 and 38 may be considered a cushioning element. For cushioning, the approximate hardness for the material comprising the nubs 36 and 38 may be less than about Shore D 90. In some embodiments, the material comprising the nubs may be about Shore A 60. One example of a cushioning element is the Epoxy Technology UV-cured adhesive OG115 from Billerica, Mass. with a Shore D hardness of approximately 86 that tends to absorb shock. When the middle armature leg 30 deflects and strikes one of the cushioning elements or nubs 36, 38, the cushioning element would absorb a portion of the impact of the middle armature leg 30. The cushioning nature of the nubs 36 and 38 further inhibits plastic deformation and damage to the middle armature leg 30 providing greater shock resistance.

The nubs 36 and 38 of the present invention are easy to apply to the transducer 10. In one embodiment, drops of adhesive are simply applied to the surface of the magnetic elements 18 and 20 prior to assembly of the transducer 10. The present invention requires no additional parts, apart from these simple nubs. The transducer 10 may be easily assembled, and the armature may be adjusted with a rather high degree of accuracy.

The transducer 10 of the present invention also provides excellent shock resistance. Shock resistance tests were performed on several samples of the transducer 10 depicted in FIGS. 1–4 "Inventive" hereinafter). For the Inventive transducers, the middle armature leg 30 has a thickness of about 0.2 mm, and the second air gap 24 is approximately 0.35 mm. Drops of UV-cured adhesive from the Lord Corporation having a hardness of about Shore D 75 formed the nubs 36 and 38 on the magnetic elements 18 and 20. The nubs 36 and 38 have a size that provides the nub air gap "d" between the tips of the nubs of approximately 0.26 to 0.27 mm. The nubs 36 and 38 have a diameter of approximately 0.5 mm. The nubs 36 and 38 are secured to the magnetic elements 18 and 20 with an edge of the nub's rounded exterior aligned with the end of the magnetic elements 18 and 20 adjacent to the coil.

To compare the shock resistance of the transducer 10 to conventional transducers, a transducer similar to the transducer 10 but without the nubs 36 and 38 "Nubless" hereinafter) was tested. Additionally, transducers produced by Knowles (Model ED1913) having deformations on the armature leg within the coil "Knowles" hereinafter) was tested. Furthermore, a Microtronic transducer (Model 2313) was tested which had a coil rotated at about 7°–8° to limit the deflection of the armature "Microtronic" hereinafter) was tested.

A free fall drop test was conducted to compare shock resistance of the Inventive, Nubless and Microtronic transducers. The test was conducted by dropping from varying heights (0 to 175 centimeters) the transducers upon a laboratory floor comprised of concrete covered by vinyl. The orientation of the transducers toward the floor was random. The distortion of the dropped transducers was measured after the free fall with a nominal input of 0.35 mVA at 1150 Hz. Table 1below illustrates the results of the free fall test with the data within the table representing percentage distortion at 1150 Hz. Table 1 also illustrates the distortion levels with symbols. No symbol represents a distortion level less than 5% distortion, an asterisk symbol (*) represents 5–10% distortion, an at symbol (@) represents 10–15% distortion and a number symbol (#) represents greater than 15% distortion.

TABLE 1

Free Fall Test Results

| Trial No. | Height 0 cm | Height 50 cm | Height 75 cm | Height 100 cm | Height 125 cm | Height 150 cm | Height 175 cm |
|---|---|---|---|---|---|---|---|
| Nubless Transducer Percentage Distortion from Free Fall Test | | | | | | | |
| 1 | 2.1 | 1.7 | 3.9 | 2.9 | 27.1# | # | # |
| 2 | 3.6 | 3.7 | 2.3 | 30.1# | 34# | # | # |
| 3 | 2.7 | 1.4 | 14.3@ | 17.4# | 15.2# | # | # |
| 4 | 2.4 | 3.1 | 2.1 | 35# | 40.8# | # | # |
| 5 | 1.5 | 1.6 | 14.7@ | 8.1* | 51.3# | # | # |
| 6 | 2.3 | 2.3 | 4.3 | 34.6# | 47.1# | # | # |
| 7 | 1.6 | 1.6 | 1.2 | 1.6 | 33# | # | # |
| 8 | 3.7 | 26.9# | 9.3* | 56.1# | 80# | # | # |
| 9 | 4.2 | 4.1 | 7.3* | 1.3 | 50# | # | # |
| 10 | 2.9 | 4.6 | 4.3 | 13.6* | 54.8# | # | # |
| Microtronic Transducer Percentage Distortion from Free Fall Test | | | | | | | |
| 1 | 2.9 | 1.7 | 2.6 | 2.6 | 1.9 | 8.7* | 10.3@ |
| 2 | 0.9 | 1.3 | 5.8* | 2.6 | 5.3* | 11.6@ | 16.9# |
| 3 | 1 | 5 | 3.1 | 1.4 | 1.8 | 2.8 | 1.9 |
| 4 | 0.9 | 1.2 | 1.3 | 1.7 | 1.3 | 1.2 | 6 |
| 5 | 1.7 | 1.7 | 1.7 | 1.6 | 13.1@ | 3.8 | 13.1@ |
| 6 | 0.9 | 1.3 | 5.4* | 10@ | 8.6@ | 16# | 20.3# |
| 7 | 1.3 | 1.7 | 2.1 | 1.9 | 16.4# | 35.7# | 37.4# |
| 8 | 2.6 | 2.6 | 3.1 | 2.2 | 2.4 | 3.5 | 16.9# |
| 9 | 2.3 | 3.2 | 1.8 | 15.6# | 1.8 | 1.6 | 2.2 |
| 10 | 1.7 | 4.4 | 2.5 | 1.5 | 1 | 1.1 | 17# |

TABLE 1-continued

Free Fall Test Results

| Trial No. | Height 0 cm | Height 50 cm | Height 75 cm | Height 100 cm | Height 125 cm | Height 150 cm | Height 175 cm |
|---|---|---|---|---|---|---|---|
| Inventive Transducer Percentage Distortion from Free Fall Test | | | | | | | |
| 1 | 1.5 | 1.1 | 1.2 | 1.4 | 2.2 | 0.9 | 1.9 |
| 2 | 1.1 | 1.3 | 1.3 | 1.5 | 1.2 | 1.2 | 8.8* |
| 3 | 1.6 | 1.9 | 2 | 2.5 | 4.6 | 2.2 | 16.9# |
| 4 | 0.9 | 1.4 | 1.3 | 0.7 | 0.9 | 13.1@ | 16.4# |

Table 1 illustrates that the Inventive transducers suffered the least distortion as of the free fall and impacts. The Microtronic transducer performed better than the Nubless transducer. Thus, the Inventive transducer provides superior shock resistance.

Figure 5:
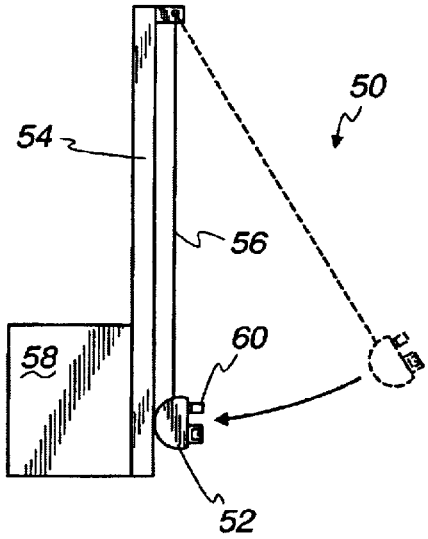
FIG. 5 is a schematic diagram of a mechanical shock test apparatus.

Additionally, to compare the shock resistance of the Inventive transducer to the conventional transducers, a mechanical shock test was performed. The mechanical shock test is illustrated in FIG. 5. The test apparatus 50 comprises a steel ball 52 having a weight of approximately one kilogram connected to a steel bar 54 having a length of approximately one meter by a string 56. A steel block 58 weighing approximately 100 kg reinforces the base of the bar 54. The shock test was conducted by fixing the transducers on the flat side of the ball 52 using double-sided tape. Although the tape most likely added mechanical damping, all transducers were tested using the same tape. Also adhered to the ball 52 is an accelerometer (B&K 8300 accelerometer) 60 to measure peak acceleration of the ball 52. The shock test comprises releasing the ball 52 at a certain distance such that the ball 52 will strike the block 58 reinforced bar 54 with the desired acceleration.

The Inventive transducer was tested with five samples being mounted to the ball 52 "cover up" and five samples mounted "cover down." When the transducers are mounted "cover down," the cover side of the transducer is affixed with the double tape to the flat side of the ball 52. When the transducers are "mounted cover up," the cover side of the transducer is opposite the flat side of the ball 52. The reason for these separate measurements is that if the armature is asymmetrically mounted, the armature can move more freely in one direction and much less in the other direction, thus the shock resistance is also asymmetrical. Ten samples of each the Nubless, Microtronic and Knowles transducers were also tested.

Figure 6:
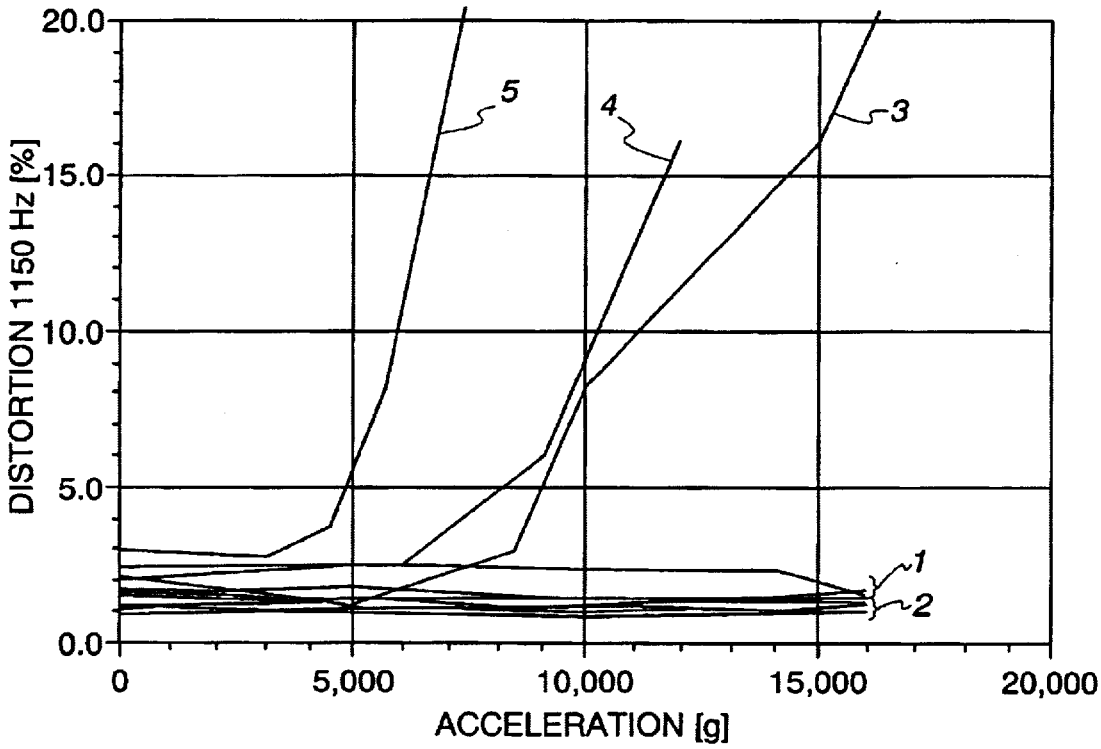
FIG. 6 is a graph of shock resistance test results.

FIG. 6 illustrates a graph of the shock resistance test with acceleration on the x-axis and percentage distortion at 1150 Hz on the y-axis. The distortion of the tested transducers was measured after the shock with a nominal input of 0.35 mVA at 1150 Hz. Referring to FIG. 6, the cluster of the lines I represents the test results for five Inventive transducers tested "cover down." The cluster of the Lines 2 represents the test results for five Inventive transducers tested "cover up." If the results of the Inventive transducers were graphed as an average, it would be nearly a horizontal line across the y-axis at less than 2% distortion. If the results of the Inventive transducers were graphed as an average, it would be nearly a horizontal line across the y-axis at less than 2% distortion. Line 3 illustrates the average test results for the Microtronic transducer. Line 4 illustrates the average test results for the Knowles transducer. Line 5 illustrates the average test results for the Nubless transducer.

FIG. 6 clearly illustrates the improved shock resistance of the Inventive transducer over the conventional transducers.

The Nubless transducers have a level of 10% distortion at approximately 6000 g. The Knowles transducers have a level of 10% distortion at approximately 10500 g. The Microtronic transducers have a level of 10% distortion at approximately 11500 g. None of the Inventive transducers have a distortion of greater than a 5% distortion over the entire test range of 16000 g. Shock resistibility is generally defined as the level for which the distortion exceeds 10%. Thus, the Inventive transducers provide significantly more shock resistance then the other transducers.

It will be appreciated that the present invention has been generally described with reference to a particular embodiment illustrated in the figures, but the present embodiment is not limited to the particular embodiments described herein. For example, the present invention may include a U-shaped armature or other suitable form instead of the illustrated E-shaped armature. For the U-shaped armature embodiment, one of the nubs 36 may be mounted on the left on the upper magnetic element 18 and the other nub 38 on the right on the lower magnetic element 20. Additionally, it is also possible that the first air gap and/or the second air gap has a non-rectangular cross section. Similarly, the nubs may have varying positions, shapes and compositions.

While particular embodiments and applications of the present invention have been illustrated and described, it is to be understood that the invention is not limited to the precise construction and compositions disclosed herein and that various modifications, changes, and variations will be apparent from the foregoing descriptions without departing from the spirit and scope of the invention as defined in the appended claims.

What is claimed is:

1. A transducer comprising:

a coil having a first air gap;

a magnetic member having a second air gap, said magnetic member including at least one nub extending into said second air gap; and an armature including an armature leg extending through said first and said second air gaps, said armature leg capable of movement within said second air gap, said nub limiting the movement of said armature leg within said second air gap.

2. The transducer of claim 1, wherein said nub is comprised of a shock absorbing material.

3. The transducer of claim 2, wherein said nub absorbs a portion of an impact of said armature leg when said armature leg moves into contact with said nub.

4. The transducer of claim 2, wherein said nub is a drop of cured adhesive secured to said magnetic member.

5. The transducer of claim 1, wherein a pair of said nubs are secured to said magnetic member, said a pair of nubs are symmetrical with respect to a longitudinal plane of said armature leg that is perpendicular to a direction of said armature movement.

6. The transducer of claim 1, wherein said first air gap and said second air gap are aligned.

7. The transducer of claim 1, wherein said nub prevents said armature leg from plastic deformation.

8. The transducer of claim 1, wherein said armature has an E-shape.

9. The transducer of claim 1, wherein said armature has a U-shape.

10. The transducer of claim 1, wherein said nubs are positioned on said magnetic member opposite a free end of said armature leg.

11. A transducer comprising:

a coil having a first air gap;

a magnetic assembly having a second air gap; said magnetic assembly include at least one cushioning element extending into said second air gap; and an armature including an armature leg extending through both said first air gap and said second air gap, said armature leg capable of movement within said second air gap, said armature leg engaging said cushioning element in response to said transducer being subject to a shock.

12. The transducer of claim 11, wherein said cushioning element is comprised of a soft material.

13. The transducer of claim 11, wherein said cushioning element absorbs a portion of an impact of said armature leg when said armature leg moves into contact with said cushioning element.

14. The transducer of claim 11, wherein said nub is a drop of cured adhesive secured to said magnetic assembly.

15. The transducer of claim 11, wherein a pair of cushioning elements are symmetrical with respect to a longitudinal plane of said armature leg that is perpendicular to a direction of said armature movement.

16. The transducer of claim 11, wherein said cushioning elements are positioned on said magnetic assembly away from a free end of said armature leg.

17. A transducer comprising:

a coil having an inner surface defining a first air gap;

a magnetic member including a pair of magnetic elements, said pair of magnetic elements being spaced apart by a distance and defining a second air gap therebetween, said first air gap and said second air gap being generally aligned;

an armature extending through said first and said second air gaps, said armature leg capable of moving within said second air gap; and at least one nub positioned on said magnetic member for limiting the movement of said armature within said second air gap.

18. The transducer of claim 17, wherein said at least one nub is positioned on one of said pair of magnetic elements.

19. The transducer of claim 18, wherein said at least one nub includes two nubs, one of said nubs being located on a first one of said pair of magnetic elements, the other of said nubs being located on a second one of said pair of magnetic elements.

20. The transducer of claim 19, wherein said pair of magnetic elements have surfaces facing each other, said surfaces being substantially parallel.

21. The transducer of claim 20, wherein said nubs are made of a material having a Shore D hardness of less than about 90.

22. The transducer of claim 21, wherein said material has a Shore D hardness of about 75.

23. The transducer of claim 21, wherein said material is a UV-cured epoxy.

24. The transducer of claim 21, wherein said nubs are cushioning elements for absorbing shock.

25. The transducer of claim 17, wherein each of said first and second gaps are substantially rectangular in cross-section.

26. The transducer of claim 25, wherein corresponding ones of the four edges defining each of said rectangular shaped cross-sections are substantially parallel.

27. The transducer of claim 17, wherein said armature has an E-shape.

28. The transducer of claim 17, wherein said armature has a U-shape.

29. The transducer of claim 17, wherein said nubs are positioned at a coil side of said magnetic member.

30. A method of increasing the shock resistance of a transducer comprising a coil defining a first air gap, a pair of magnetic elements being spaced apart by a distance and defining a second air gap that is lateral to and generally aligned with said first air gap, and a moveable armature extending through said first and said second air gaps, said method comprising:

decreasing the size of the said second air gap by adding a material to said pair of magnetic elements to absorb shock, said material being a cushioning element having a Shore D hardness of less than about 90.

31. The method of claim 30, wherein said step of adding material includes the step of providing a smooth rounded shape to a surface of said material that is to contact said armature.

32. The method of claim 30, wherein said material is added at a coil side of said pair of magnetic elements.

* * * * *